US005417535A

United States Patent [19]

Andjelic et al.

[11] Patent Number: 5,417,535

[45] **Date of Patent: * May 23, 1995**

[54] METHOD OF AND APPARATUS FOR MAKING BOOKS, BROCHURES AND THE LIKE

[75] Inventors: Milan Andjelic, Bad Oldesloe; Peter Hüser, Ellerau, both of Germany

[73] Assignee: E.C.H. Will GmbH, Hamburg, Germany

[ * ] Notice: The portion of the term of this patent subsequent to Mar. 22, 2011 has been disclaimed.

[21] Appl. No.: 168,778

[22] Filed: Dec. 16, 1993

Related U.S. Application Data

[63] Continuation-in-part of Ser. No. 988,459, Dec. 10, 1992, Pat. No. 5,295,775.

[30] Foreign Application Priority Data

Dec. 18, 1991 [DE] Germany ..... 41 41 767
Apr. 5, 1993 [DE] Germany ..... 43 11 152.1

[51] Int. Cl.[6] ..... B42C 9/00

[52] U.S. Cl. ..... 412/2; 412/4; 412/8; 412/16; 412/19; 412/22; 412/37

[58] Field of Search ..... 412/2, 4, 6, 8, 16, 412/19, 21, 22, 26, 28, 32, 37

[56] References Cited

U.S. PATENT DOCUMENTS 4,151,037 4/1979 Klingelhoefer et al. ..... 156/477 B
4,629,058 12/1986 Reissmann et al. ..... 198/461
5,004,094 4/1991 Brandt ..... 198/460
5,295,775 3/1994 Andjelic et al. ..... 412/2

FOREIGN PATENT DOCUMENTS 0553870 8/1993 European Pat. Off. .
2428617 7/1984 Germany .
2186840 8/1987 United Kingdom .

*Primary Examiner*—Tom Hughes
*Attorney, Agent, or Firm*—Darby & Darby

[57] ABSTRACT

Books or brochures are produced by transporting a series of elongated piles of superimposed paper sheets longitudinally through at least one bonding station where certain marginal portions of the sheets of each pile are adhesively connected to each other, and thereupon sideways through a laminating station wherein the piles are provided with rigid or semirigid covers which are glued to the outer sides of their outermost sheets. The piles are then advanced lengthwise through a back-stripping station, are compressed subsequent to stacking, singularized, trimmed, stacked and thereupon subdivided into stacks of superimposed books or brochures.

27 Claims, 4 Drawing Sheets

Fig.1a
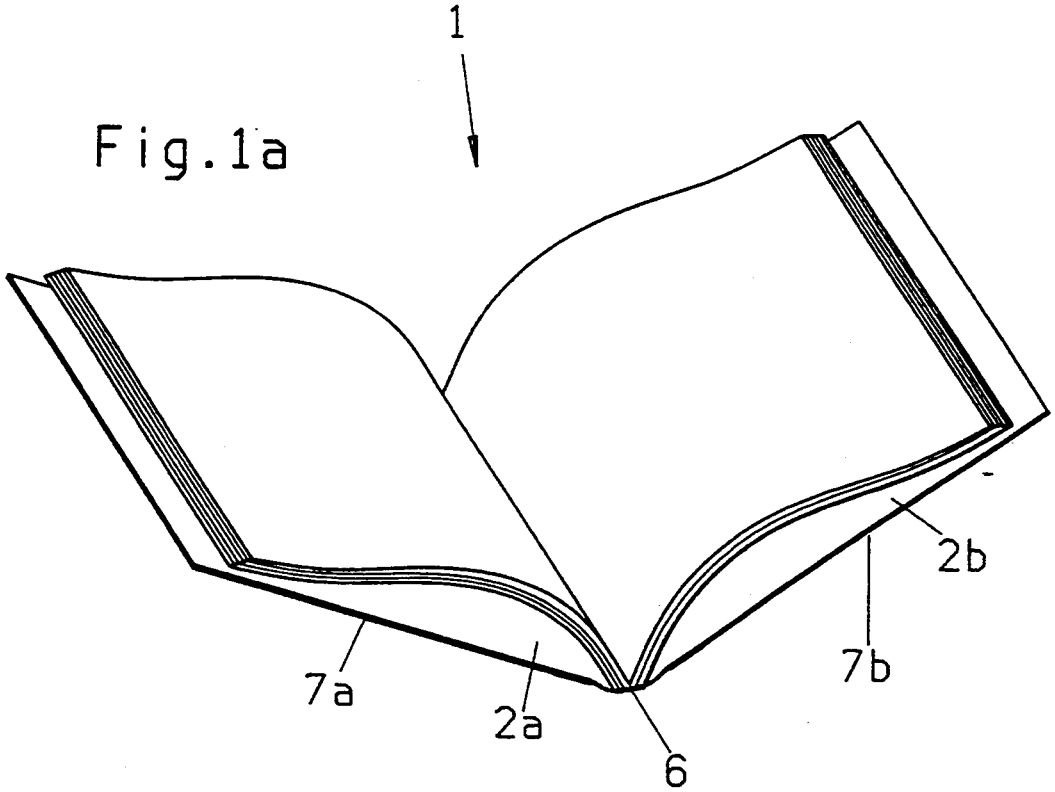
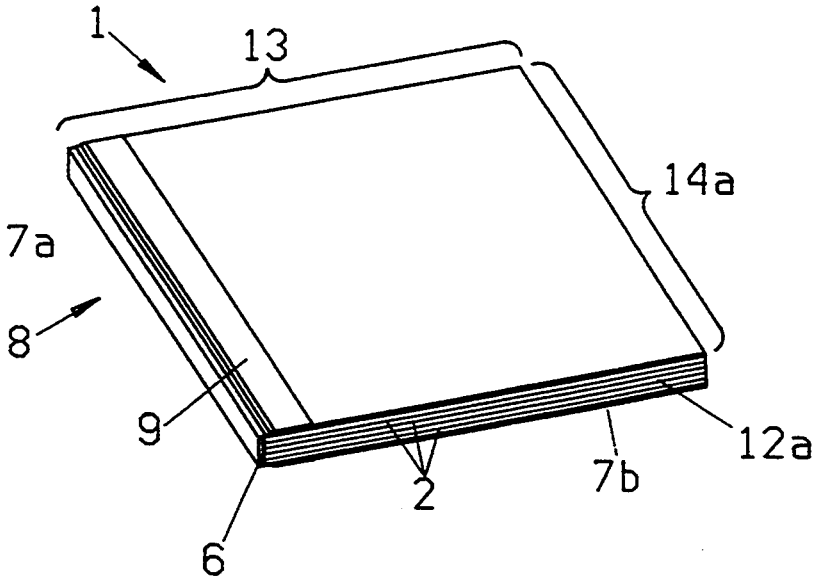
Fig.1b

METHOD OF AND APPARATUS FOR MAKING BOOKS, BROCHURES AND THE LIKE

CROSS-REFERENCE TO RELATED CASE

This is a continuation-in-part of our commonly owned patent application Ser. No. 07/988,459, filed Dec. 10, 1992, for "Method of and apparatus for making books", now U.S. Pat. No. 5,295,175, granted Mar. 2, 1994.

BACKGROUND OF THE INVENTION

The invention relates to improvements in methods of and in apparatus for making collections of sheets in the form of books, brochures and analogous articles (hereinafter called books for short). More particularly, the invention relates to improvements in methods of and in apparatus for making books from piles of overlapping sheets which can be converted into discrete books.

It is already known to connect the sheets of successive piles of overlapping sheets to each other, to fold the piles so that each folded pile has two outermost sheets, to attach a cover to each outermost sheet, and to thereupon subdivide each pile into two or more discrete books.

OBJECTS OF THE INVENTION

An object of the invention is to provide an automatic method of making high-quality books.

Another object of the invention is to provide a method which renders it possible to turn out large numbers of books per unit of time.

A further object of the invention is to provide a novel and improved method of securing covers, for example, rigid or semirigid covers, to outermost sheets of piles of sheets in the course of a book producing operation.

An additional object of the invention is to provide a method which renders it possible to enhance the appearance of books with little loss in time.

Still another object of the invention is to provide a novel and improved method of making backstripped books.

A further object of the invention is to provide a novel and improved method of making large numbers of books in a small area.

Another object of the invention is to provide a novel and improved method of transporting components of books in a book producing plant.

An additional object of the invention is to provide a novel and improved method of simultaneously converting large numbers of piles of overlapping sheets into discrete books.

Still another object of the invention is to provide a novel and improved apparatus for the practice of the above outlined method.

A further object of the invention is to provide the apparatus with novel and improved means for transporting the component parts of books, such as piles of loosely overlapping sheets and interconnected sheets, back strips and covers.

Another object of the invention is to provide the above outlined apparatus with novel and improved means for securing covers, such as rigid or semirigid covers, to outermost sheets of piles of sheets.

An additional object of the invention is to provide the above outlined apparatus with novel and improved means for enhancing the appearance of books.

Still another object of the invention is to provide the apparatus with novel and improved means for manipulating piles of sheets.

A further object of the invention is to provide the apparatus with novel and improved means for grouping and/or otherwise assembling piles of sheets of paper or the like.

SUMMARY OF THE INVENTION

One feature of the present invention resides in the provision of a method of making collections of pages (including books and brochures) from back strips, covers and piles with each pile composed of a plurality of overlapping sheets having neighboring marginal portions and a size several times that of a page. The improved method comprises the steps of transporting a series of successive piles along a predetermined path, bonding the marginal portions of the sheets to,each other in at least one first portion of the path to form piles of coherent sheets with each pile of coherent sheets having two outermost sheets and with the bonded marginal portions constituting the spine of the pile of coherent sheets, adhesively securing the outermost sheets of successive piles of coherent sheets to covers in at least One second portion of the path, affixing back strips to the spines of successive piles of coherent sheets in at least one third portion of the path, and thereafter converting each pile of coherent sheets into at least two collections of sheets in at least one fourth portion of the path.

The bonding step can include welding the marginal portions of neighboring sheets to each other by heat and/or pressure. However, it is presently preferred to select a bonding step which includes securing the marginal portions of sheets in each pile to each other with a suitable adhesive.

The step of affixing back strips can include adhesively affixing the back strips prior or subsequent to the securing step, i.e., prior or subsequent to bonding of covers to the outermost sheets of successive piles of coherent sheets.

Each pile can comprise elongated sheets having pairs of parallel long sides, and the aforementioned marginal portion of each sheet then preferably extends along one of the long sides. The transporting step can include advancing successive piles at the at least one first portion of the path in the direction of the long sides of the respective sheets, and the bonding step can include adhesively affixing the marginal portions of the sheets of each of the series of piles to each other in such direction. The transporting step of such method can further comprise advancing successive piles transversely of the long sides of the respective sheets upon completion of the bonding step.

The transporting step can include advancing successive piles substantially at right angles to the long sides of the respective sheets during transport at the at least one second portion of the path. The step of adhesively securing the outermost sheets of each pile of coherent sheets to covers can include conveying a succession of first covers to the at least one second portion of the path in the direction of the long sides of the sheets of piles advancing at the at least one second portion of the path, attaching successive first covers to one outermost sheet of each of the series of piles, inverting successive piles and the respective first covers, conveying a succession of second covers to the at least one second portion of the path in the direction of the long sides of sheets in piles advancing at the at least one second portion of the path, and attaching successive second covers to the other outermost sheet of each inverted pile of the series of piles.

The transporting step can include advancing successive piles at the at least one first portion as well as at the at least one third portion of the path in the direction of the long sides of the sheets.

The converting step can comprise trimming at least the piles and the respective covers in the at least one fourth portion of the path. Such trimming can also involve trimming of the attached back strips (if necessary). The converting step of such method can further comprise assembling groups of successive trimmed piles, and such assembling step can include superimposing trimmed piles upon each other. The converting step of such method can further comprise accumulating groups of trimmed piles into blocks, and the transporting step of such method can comprise advancing successive piles substantially at right angles to the long sides of the respective sheets in the course of the trimming and assembling steps. Still further, the converting step of such method can comprise subdividing the piles of the aforementioned groups and/or blocks into collections of sheets (e.g., into books or brochures), and the transporting step can comprise advancing the piles in the direction of the long sides of their respective sheets in the course of the subdividing step. Still further, the converting step of such method can also comprise singularizing the subdivided piles of the groups and/or blocks, and the transporting step can comprise advancing the subdivided piles transversely of the long sides of the sheets of such piles in the course of the singularizing step. If at least some of the collections of sheets exhibit pronounced edges, the method can further comprise the steps of aligning the collections of sheets and rounding or similarly treating the pronounced corners of the at least some collections of sheets upon completion of or in the course of the aligning step.

Another feature of the present invention resides in the provision of an apparatus for making collections of sheets (including books and brochures) from back strips, covers and piles each of which is composed of a plurality of overlapping sheets having neighboring marginal portions. The improved apparatus comprises means for transporting successive piles of a series of piles along at least one elongated path, means for bonding the marginal portions of the sheets of each of the series of piles to each other in at least one first portion of the at least one path to form piles of coherent sheets with each pile of coherent sheets having two outermost sheets and with the bonded marginal portions constituting a spine of the pile of coherent sheets, means for adhesively securing the outermost sheets of successive piles of coherent sheets to covers in at least one second portion of the at least one path, means for preferably adhesively affixing back strips to the spines of successive piles of coherent sheets in at least one third portion of the at least one path, and means for converting successive backstripped piles of coherent sheets into collections of sheets (such as books or brochures) in at least one fourth portion of the at least one path.

The bonding means can include means for securing the marginal portions of each pile to each other with a suitable adhesive.

The transporting means can include means for advancing the piles in a predetermined direction, and the at least one second portion of the at least one elongated path can be disposed upstream or downstream of the at least one third portion of the path.

Each pile can comprise elongated sheets having pairs of parallel long sides and the transporting means can comprise means for advancing successive piles of the series in the direction of the long sides of the respective sheets during transport of piles along the at least one first portion of the at least one path.

Alternatively, or in addition to the just described construction, the transporting means can include means for advancing successive piles of the series of piles at least substantially at right angles to the long sides of the respective sheets along the at least one second portion of the at least one path. The securing means of such apparatus can include first conveyor means for conveying a succession of first covers from a suitable source (e.g., a magazine) to successive piles of the series of piles in the at least one second portion of the at least one path, means for attaching successive first covers to one outermost sheet of each of the series of successive piles in the at least one second portion of the at least one path, means for inverting successive piles and the respective first covers, second conveyor means for conveying a succession of second covers from a source (e.g., a second magazine) to successive inverted piles, and means for attaching successive second covers to the other outermost sheet of each of the series of successive inverted piles. The securing means can further include a first adhesive applying coating device (e.g., a paster) adjacent the first conveyor means and a second adhesive applying coating device (e.g., a paster) adjacent the second conveyor means.

The apparatus can also comprise means for compressing successive piles of the series of piles in a further portion of the at least one path downstream of the at least one second portion of such path.

The converting means of the improved apparatus can comprise means for trimming successive piles of the series of piles and the respective covers downstream of the at least one second portion of the at least one path or downstream of the at least one second and the at least one third portion of the at least one path.

The converting means can also comprise means for assembling successive piles of the series of piles, together with the respective first and second covers and the respective back strips, into a series of successive blocks each having a single layer of neighboring piles or plurality of superimposed piles, and means for subdividing the piles of successive blocks of the series of blocks into discrete collections of sheets (e.g., discrete books, brochures, pamphlets, magazines or the like).

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

BRIEF DESCRIPTION OF THE DRAWINGS

FIG. 1*a* is a perspective view of an open book which is produced in accordance with the method and in the apparatus of the present invention;

FIG. 1*b* is a perspective view of the book in closed position;

DESCRIPTION OF PREFERRED EMBODIMENTS

Figure 2A:
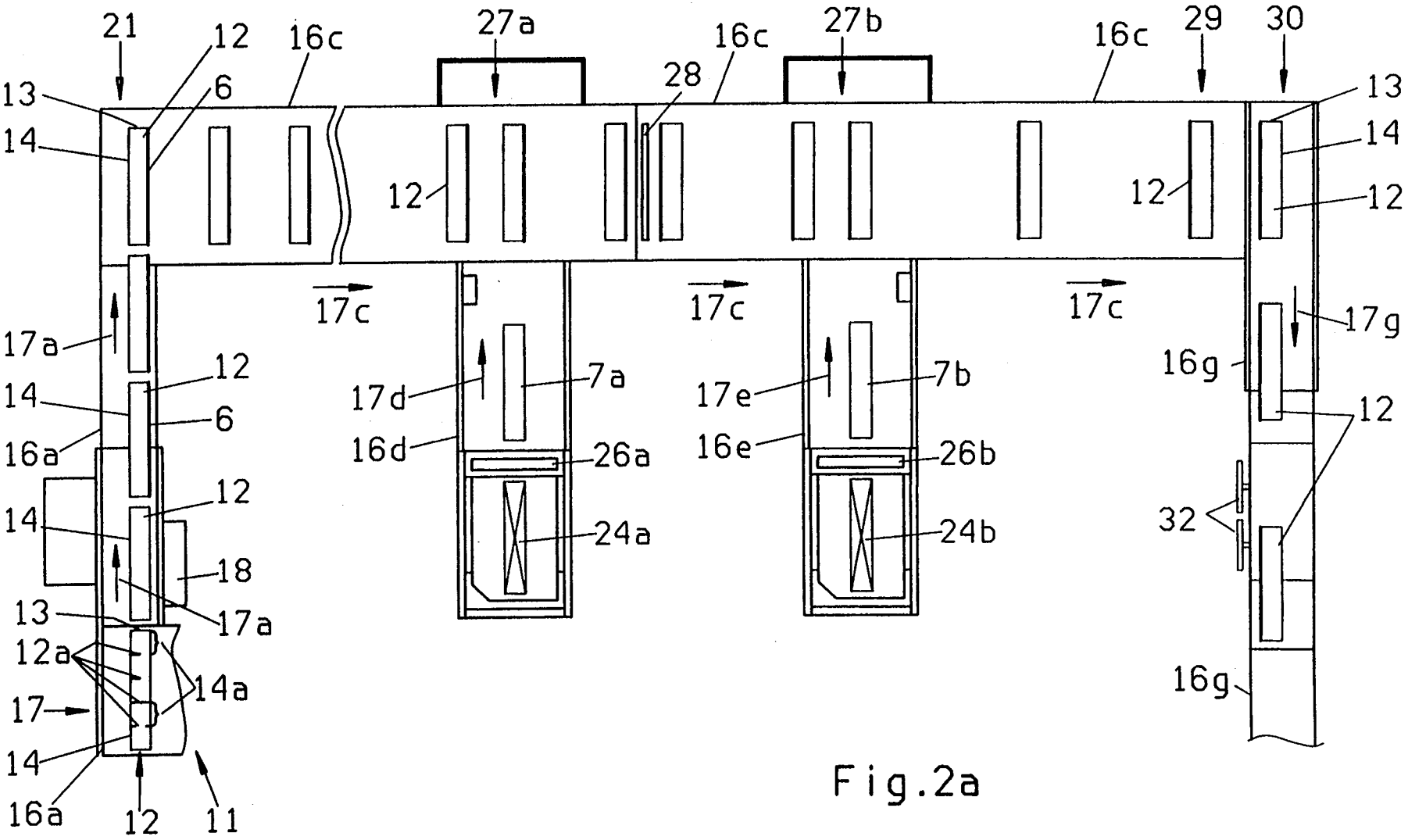
FIG. 2*a* is a schematic plan view of a first portion of an apparatus which embodies one form of the invention.

FIGS. 1*a* and 1*b* show a collection 1 of sheets in the form of a book or brochure, and hereinafter called book for short, which can be made in accordance with the method and in the apparatus of the present invention. The book 1 comprises pages or sheets 2 including a foremost sheet or page 2*a* and the rearmost sheet or page 2*b*. The page 2*a* is bonded to the adjacent side of a preferably rigid or semirigid front cover 7*a*, and the page 2*b* is bonded to the adjacent side of a preferably rigid or semirigid rear cover 7*b*. The back or spine 8 of the pile or stack 12*a* which forms the pages or sheets is overlapped by and is bonded to a so-called back strip 9 which also overlies the adjacent marginal portions of the outer sides of covers 7*a* and 7*b* (FIGS. 2 and 2*b*) or which can be overlapped by the adjacent portions of the covers (FIG. 3). The reference character 6 denotes a bonded joint or connection including a suitable adhesive which connects the marginal portions of neighboring sheets 2 to each other along the back strip 9. Each page 2 is or can be obtained by severing a larger (longer) sheet forming part of a pile to be described in detail with reference to FIGS. 2*a* and 2*b*. The pages 2 can be made of paper and the covers 7*a*, 7*b* can be made of cardboard, stiff paper, plastic or any other suitable material. The back strip 9 can be made of paper, plastic, textile or another suitable flexible material which can be bonded to the spine 8 and/or to the covers 7*a*, 7*b*. Though FIGS. 1*a* and 1*b* show a book 1 with substantially rectangular pages (each having a height 14*a* and a width 13), it is equally possible to make the book with at least substantially square pages or with pages which are elongated in the direction of the spine 8.

Figure 2B:
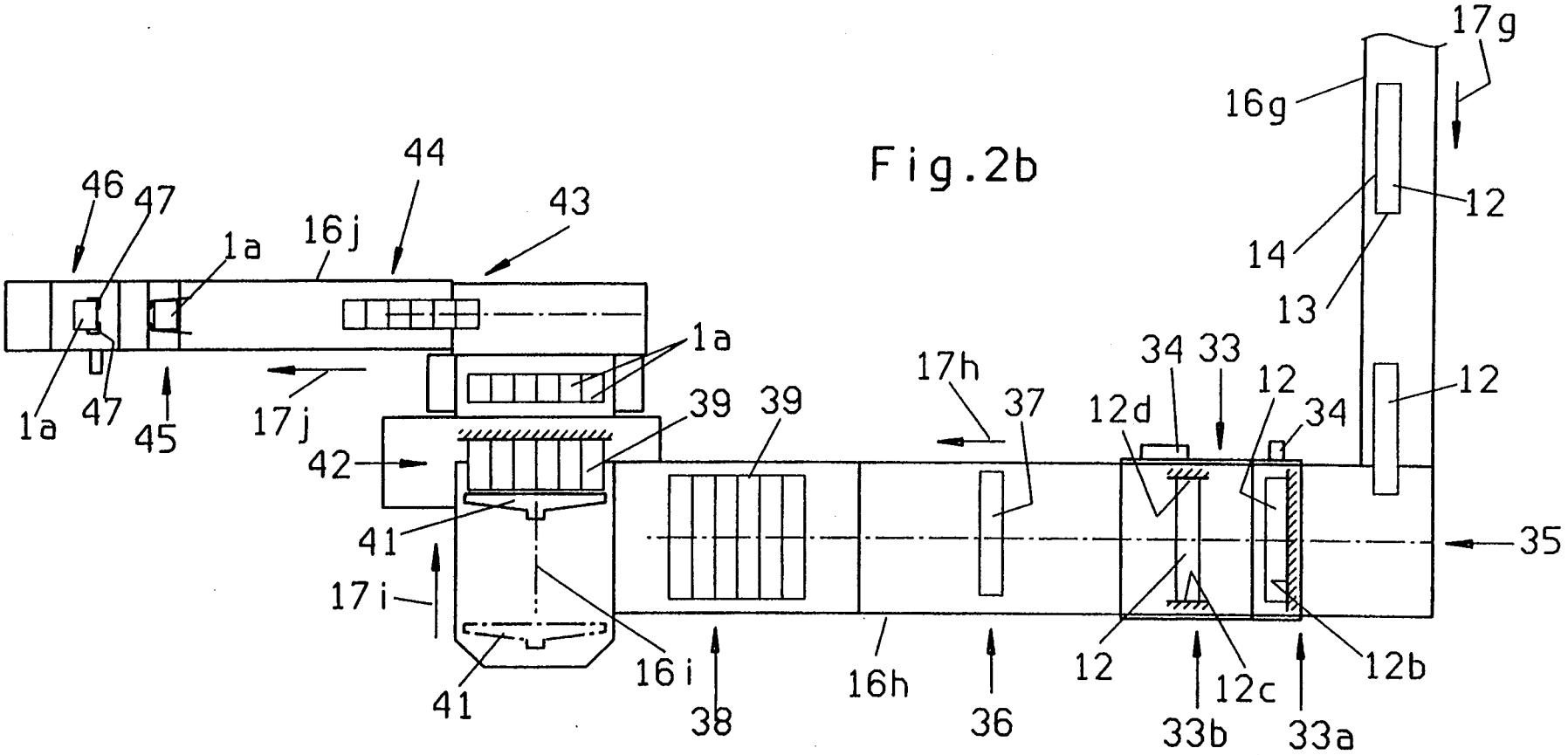
FIG. 2*b* is a schematic plan view of the remaining portion of the apparatus.
Figure 3:
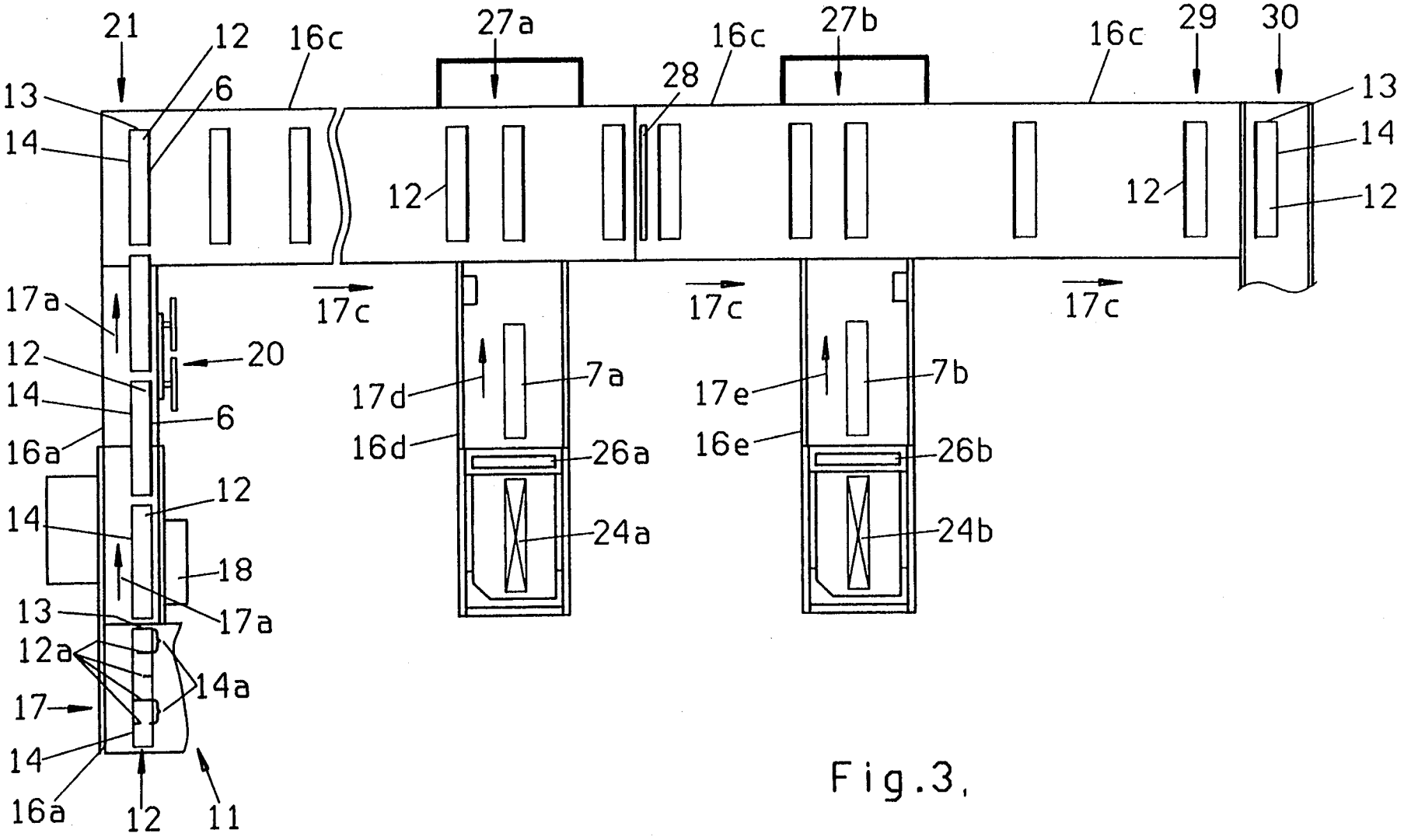
FIG. 3 is an enlarged plan view of a first portion of a modified apparatus.

FIGS. 2*a* and 2*b* show those components of an improved book manufacturing apparatus which are considered necessary for full understanding of the invention. Such components are illustrated in a plan view and are shown in a distribution such that the apparatus assumes the shape of a substantially square or rectangular production line. The apparatus includes a composite transporting unit having a series of conveyors 16*a*, 16*c* to 16*e*, and 16*g* to 16*j* which together define an elongated path denoted by arrows 17*a*, 17*c* to 17*e* and 17*g* to 17*j*.

The inlet (at 11) of the elongated path receives a series of successive multiple-size piles or stacks 12 (hereinafter called piles for short) of overlapping sheets or panels each having a size approximately five times that of the size of a page 2*a* or 2*b*. The number of sheets in a pile 12 matches the number of pages in a book 1, and the length of each pile 12 is five times 14*a*, namely five times the height of a page 2*a* or 2*b* as measured in the direction of the spine 8 of a book 1.

The layers 12 can be formed at the inlet 11 of the elongated path, or they can be delivered to the inlet by conveyor means from one or more partially or fully automated sheet piling or stacking machines. One presently preferred mode of assembling piles 12 is to draw a web off a bobbin, provide (if necessary) at least one side of the web with printed matter and/or other information, employ a cross cutter in order to subdivide the web into a series of sheets, and to thereupon stack requisite numbers of sheets on top of each other to form a succession of piles 12. The thus (or otherwise) formed piles 12 are delivered to the inlet 11 in the direction which is indicated by the arrow 17, e.g., by one or more automatically operated conveyors (not shown) to ensure delivery of piles at required intervals.

It is within the purview of the invention to assemble the sheets into discrete piles 12 by resorting to semiautomatic stacking means and to transfer the piles 12 into the inlet 11*a* by hand.

The width 13 (i.e., the length of a short side) of each pile 12 matches the width of a closed book 1, i.e., it equals the width of a page 2*a* or 2*b*. The length of the long sides 14 of a pile 12 is five times the length 14*a* of a page 2*a* or 2*b* (as measured in the direction of the spine 8 of a book) because each of the illustrated piles is dimensioned to be assembled with two covers 7*a*, 7*b* of equal length and to be thereupon severed in parallelism with its short sides 13 to yield five books 1. In other words, the length of a long side 14 equals five times the height 14*a* of a book 1. The locations where the layers 12 are to be severed in order to yield sets of five books 1 each are indicated in FIG. 2*a*, as at 12*a*. As used herein, the term "multiple" is intended to denote the number of books which can be produced from a pile 12 in combination with a back strip 9 and two covers.

The first conveyor 16*a* transports successive piles 12 of a series of piles in the direction which is indicated by the arrows 17*a*. Thus, the freshly admitted piles 12 are transported in the directions of their long sides 14. Successive piles 12 which advance in the direction of arrow 17*a* move toward, through and beyond a first portion of their path, and such first portion accommodates a machine 18 which bonds marginal portions of the sheets in successive piles to each other. The illustrated machine 18 is a paster which is designed to make bonded joints 6 of the type shown in FIGS. 1*a*, 1*b* and 2. Such joints 6 are adjacent one long side 14 of the respective pile 12. The exact construction of the paster 18 forms no part of the invention. Such paster can apply films of adhesive to the right-hand edge faces of successive piles 12, as viewed in FIG. 2*a*. The machine 18 can also be designed and set up in such a way that it provides joints only along a certain portion of the right-hand edge face of each of the five coherent sections of a pile 12. It is presently preferred to employ a machine 18 which makes a continuous joint 6 all the way between the two short sides 13 of each of a series of successive piles 12.

The piles 12 which advance beyond the machine 18 reach a deflecting or diverting station 21 and are taken over by the conveyor 16*c* which also forms part of the transporting unit and is constructed and assembled to advance the piles 12 sideways (arrows 17*c*), i.e., at right angles to their long sides 14 and in at least substantial parallelism with the short sides 13. The conveyor 16*c* advances successive piles 12 toward, through and beyond an inverting or turnaround device or unit 28 at a composite laminating station between two laminating units 27*a* and 27*b*. The device 28 can include a star-shaped turret which has radially outwardly extending open pockets and is indexable about a horizontal axis (see FIG. 3 of U.S. Pat. No. 5,295,775). The conveyor 16*c* actually delivers successive piles 12 first to the discharge end of a conveyor 16*d* which is located upstream of the turn around device 28 and advances successive covers 7*a* in the direction (arrow 17*d*) of their long sides into the range of the first laminating unit 27*a*. The latter includes means for adhesively securing one outermost sheet of each pile 12 to a discrete cover 7*a* having a length corresponding to that of a long side 14 and a width equal to or perhaps slightly less than the width 13 of a pile 12. The laminating unit 27*a* comprises a source of stacked covers 7*a*, namely a magazine 24*a*. A coating device or paster 26*a* is adjacent the path of movement of successive covers 7*a* from the magazine 24*a* toward the conveyor 16*c*. The coating device or paster 26*b* of the laminating unit 27*b* is adjacent the path of movement of successive covers 7*b* from a magazine 24*b* to the conveyor 16*c*. The manner in which the covers 7*a* are transported by the conveyor 16*d* in the direction of arrow 17*d* and the covers 7*b* are transported by the conveyor 17*e* in the direction of arrow 17*e* is analogous to that described and shown in U.S. Pat. No. 5,295,775 to which reference can be had, if necessary. The purpose of the paster 26*a* is to preferably fully coat one side of each cover 7*a* with a film of suitable adhesive so that such cover can be caused to adhere to the outer side of the upper outermost sheet (consisting of five coherent sheets 2*a*) of the pile 12 in the laminating unit 27*a* ahead of the inverting device 28. The latter then turns the pile 12 and the cover 7*a* through 180° to thus position the Other outermost sheet (consisting of five coherent sheets 2*b*) of the pile 12 on top at the laminating unit 27*b*. The unit 27*b* then receives a cover 7*b*, one side of which has been preferably fully coated with a film of adhesive in the paster 26*b*, and such cover 7*b* is caused to adhere to the Upper side of the other outermost sheet before the resulting assembly of a pile 12 and covers 7*a*, 7*b* is transported by the conveyor 16*c* in the direction (arrow 17*c*) of the short sides 13 of the pile 12 toward and onto the conveyor 16*g*. The direction of transport of a pile 12 with two covers 7*a*, 7*b* is changed from that indicated by the arrows 17*c* to that indicated by the arrow 17*g* after the piles 12 have advanced through a compressing station 29 of the type disclosed in U.S. Pat. No. 5,295,775. The deflecting or diverting station between the conveyors 16*c* and 16*g* is denoted by the character 30.

Successive piles 12 which are in the process of advancing (arrow 17*c*) to the compressing station 29 are or can be gathered into groups of superimposed piles and such groups are then subjected to the action of a compressing means, such as the press 89 shown in FIG. 4 of U.S. Pat. No. 5,295,775, to complete the bonding of covers 7*a*, 7*b* to the outer sides of the respective outermost sheets of the piles 12. An advantage of the step of gathering predetermined numbers of successively advanced piles 12 (with covers 7*a*, 7*b* attached thereto) into groups is that the period of dwell in the press can be prolonged without causing the development of a bottleneck at the compressing station 29.

The piles 12 of successive groups are singularized downstream of the press 89 (see the right-hand portion of FIG. 4 in U.S. Pat. No. 5,295,775, and the singularized laminated piles 12 are taken over by the conveyor 16*g* which advances them (arrows 17*g*) in the direction of their long sides 14 as shown in the right-hand portions of FIGS. 2*a* and 2*b*.

The conveyor 16*g* advances successive piles 12 through a backstripping unit 32 which can be of the type disclosed, for example, in German Pat. No. 24 28 617 or in U.S. Pat. No. 4,151,037. The unit 32 is designed to apply back strips 9 to the spines 8 of successive laminated piles 12 while the piles advance in the direction of their long sides 14 (arrows 17*g*). The width of each back strip 9 can be such that it overlies the respective spine 8 as well as the outer sides of the adjacent portions of the respective covers 7*a* and 7*b*.

The paster 18 is located at a first portion of the path of the piles 12, the laminating units 27*a*, 27*b* and the turn around device 28 are located in the second portion, the compressing station 29 is located in the third portion, and the unit 32 is located in the fourth portion of the path of piles 12.

The laminated and backstripped piles 12 are then taken over (at a deflecting or diverting station 35) by the conveyor 16*h* which advances them (arrow 17*h*) at right angles to their long sides 14 on to a trimming unit 33 of any known design. The illustrated trimming unit 33 includes a first portion or section 33*a* which serves to trim the long edges 12*b* of successive backstripped piles 12, and a second portion or section 33*b* which serves to trim the two shorter edges 12*c*, 12*d* of successive backstripped piles 12. The waste, i.e., the material which was removed from the sheets and from the covers of successive backstripped piles 12, is collected by a device 34, e.g., a suitable vacuum cleaner or the like.

The trimmed backstripped piles 12 are advanced to a station accommodating a superimposing unit 36 which converts preselected numbers of successively advanced piles 12 into groups 37 of superimposed piles. The groups 37 are advanced into the range of a positioning unit 38 which assembles preselected numbers of successively delivered groups 37 into blocks 39 of closely adjacent groups before the thus obtained blocks 39 reach a fifth portion of the path which accommodates a subdividing unit 42.

The subdividing unit 42 comprises a pusher 41 which advances the adjacent block 39 stepwise in the direction of arrow 17*i* and forms part of the conveyor 16*i*. The pusher 41 is reciprocable in the directions of long sides 14 of backstripped piles 12 which form the block 39 on the conveyor 16*i*, and this pusher cooperates with a severing device forming part of the subdividing unit 42 to convert the block 39 into a number of files 43 of stacks 1*a* of superimposed books 1. The severing device of the subdividing unit 42 can be constructed and can operate in a manner as disclosed, for example, in published German patent application Ser. No. 36 03 484. Successive files 43 are taken over by the conveyor 16*j* which advances them in the direction of arrow 17*j* (i.e., at right angles to the long sides 14 of piles 12 in the preceding portions of their path). The files 43 are broken up (i.e., the stacks 1*a* are singularized) at a singularizing station 44, and the singularized stacks la are advanced to an aligning station 45 and thence to a rounding or round trimming station 46 which is provided with means for trimming the normally pronounced corners 47 of the books 1 in the stacks 1*a* before the thus finished stacks 1*a* are transferred to storage or to another destination. The equipment at the singularizing station 44 can be identical with or analogous to that disclosed, for example, in U.S. Pat. Nos. 4,629,058 or 5,004,094.

The construction of various conveyors 16*a* to 16*j* forming part of the transporting unit for the piles 12 (without and thereafter with covers 7*a*, 7*b* and back strips 9) is or can be such that the commodities thereon are advanced in stepwise fashion. This can be achieved by resorting to intermittently driven belt, band or chain conveyors and/or to intermittently operated pushers or analogous entraining elements. It is also possible to resort to suction operated conveyors, e.g., for the delivery of back strips and/or covers *7a, 7b* into the path for the piles 12.

Each of the pasters 26*a*, 26*b* in the laminating units 27*a*, 27*b* can comprise a driven roller which dips into a supply of paste in a vessel or tank. The surplus of withdrawn adhesive paste is removed from the peripheral surface of the driven roller by a roller-shaped squeegee so that the peripheral surface 7 of the driven roller carries a thin film of adhesive which is applied to the adjacent side of the cover *7a* or *7b*.

FIG. 3 shows a portion of a modified apparatus. All such parts of thins modified apparatus which are identical with or clearly analogous to corresponding parts of the apparatus of FIGS. 2*a* and 2*b* are denoted by similar reference characters. The only difference between the apparatus of FIGS. 2*a*–2*b* and the apparatus of FIG. 3 is that the back stripping unit 32 of the modified apparatus is installed upstream of the laminating units 27*a*, 27*b*, namely adjacent the conveyor 16*a* and downstream of the adhesive applying paster 18. Thus, the back strips 9 which are applied in the apparatus of FIG. 3 have longitudinally extending marginal portions which are overlapped by the respective covers *7a* and *7b* in contrast to the apparatus of FIGS. 2*a*–2*b* wherein the longitudinally extending marginal portions of the back strips 9 overlap the respective covers *7a* and *7b*.

All other operations in the apparatus of FIG. 3 are or can be identical with or analogous to those described in connection with the apparatus of FIGS. 2*a* and 2*b*.

An advantage of the improved method and apparatus is that they render it possible to turn out large numbers of high-quality books 1 per unit of time. An important reason for the ability of the apparatus to turn out large numbers of books per unit of time is that the apparatus can treat piles 12 each of which can be subdivided into a substantial number of individual books. It is to be understood that the dimensions of the piles 12 can be increased (to yield more than five books) or reduced without departing from the spirit of the invention.

Another advantage of the improved method and apparatus is that the method can be practiced in a compact apparatus. The reason is that, wherever possible, the piles 12 are transported in directions at right angles to their long sides 14. This also holds true for the treatment at stations (such as those accommodating the laminating units 27*a*, 27*b* and the compressing means at the station 29) which, in conventional apparatus, are disposed adjacent path portions wherein the piles are advanced lengthwise rather than sideways.

The laminating units 27*a* and 27*b* permit fully automatic and accurate application of covers *7a* and *7b* to the outer sides of the outermost sheets of successive piles 12 in a small area and at a high frequency. Those units can be designed to provide the piles 12 with soft covers even though it is often preferred to employ rigid or semirigid covers.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of making collections of pages from back strips, covers and piles with each pile composed of a plurality of overlapping sheets having neighboring marginal portions and a size several times that of a page, comprising the steps of transporting a series of successive piles along a predetermined path; bonding the marginal portions of the sheets to each other in at least one first portion of said path to form piles of coherent sheets with each pile of coherent sheets having two outermost sheets and with the bonded marginal portions constituting the spine of the pile of coherent sheets; adhesively securing the outermost sheets of successive piles of coherent sheets to covers in at least one second portion of said path; affixing back strips to the spines of successive piles of coherent sheets in at least one third portion of said path; and thereafter converting each pile of coherent sheets into at least two collections of sheets in at least one fourth portion of said path.

2. The method of claim 1, wherein said bonding step includes securing the marginal portions of sheets in each pile to each other with an adhesive.

3. The method of claim 1, wherein said step of affixing back strips includes adhesively affixing the back strips and is carried out prior to said securing step.

4. The method of claim 1, wherein said step of affixing back strips includes adhesively affixing the back strips and is carried out subsequent to said securing step.

5. The method of claim 1, each of the piles comprising elongated sheets having pairs of parallel long sides, wherein said transporting step includes advancing successive piles at the at least one first portion of said path in the direction of the long sides of the sheets, said bonding step including adhesively affixing the marginal portions of the sheets of each of the series of piles to each other in said direction, said transporting step further including advancing successive piles transversely of the long sides of the respective sheets upon completion of said bonding step.

6. The method of claim 1, each of the piles comprising elongated sheets having parallel long sides, wherein said transporting step comprises advancing successive piles substantially at right angles to the long sides of the respective sheets during transport at the at least one second portion of said path, said step of adhesively securing including conveying a succession of first covers to the at least one second portion of the path in the direction of the long sides of the sheets of piles advancing at said at least one second portion of said path, attaching successive first covers to one outermost sheet of each of said series of piles, inverting successive piles and the respective first covers, conveying a succession of second covers to the at least one second portion of the path in the direction of the long sides of sheets of piles advancing at said at least one second portion of said path, and attaching successive second covers to the other outermost sheet of each inverted pile of said series of piles.

7. The method of claim 1, each of said piles comprising elongated sheets having pairs of parallel long sides, said transporting step comprising advancing successive piles at the at least one first portion and the at least one third portion of said path in the direction of the long sides of the sheets.

8. The method of claim 1, wherein said converting step comprises trimming at least the piles and the respective covers in said at least one fourth portion of said path.

9. The method of claim 8, wherein said converting step further comprises assembling groups of successive trimmed piles.

10. The method of claim 9, wherein said assembling step includes superimposing trimmed piles upon each other.

11. The method of claim 9, wherein said converting step further comprises accumulating groups of trimmed piles into blocks.

12. The method of claim 9, each of the piles comprising elongated sheets having parallel long sides, wherein said transporting step comprises advancing successive piles substantially at right angles to the long sides of the respective sheets in the course of said trimming and assembling steps.

13. The method of claim 9, wherein said converting step further comprises subdividing the piles of said groups into collections of sheets, each of said piles comprising elongated sheets having parallel long sides and said transporting step including advancing the piles in the direction of the long sides of the respective sheets in the course of said subdividing step.

14. The method of claim 13, wherein said converting step further comprises singularizing the subdivided piles of said groups, said transporting step further comprising advancing the subdivided piles transversely of said direction in the course of said singularizing step.

15. The method of claim 14, at least some of said collections of sheets having pronounced corners and further comprising the steps of aligning the collections of sheets and rounding the pronounced corners of said at least some collections of sheets upon completion of said aligning step.

16. Apparatus for making collections of sheets from back strips, covers and piles with each pile composed of a plurality of overlapping sheets having neighboring marginal portions, comprising means for transporting successive piles of a series of piles along at least one elongated path; means for bonding the marginal portions of the sheets of each of said series of piles to each other in at least one first portion of said at least one path to form piles of coherent sheets with each pile of coherent sheets having two outermost sheets and with the bonded marginal portions constituting a spine of each pile of coherent sheets; means for adhesively securing the outermost sheets of successive piles of coherent sheets to covers in at least one second portion of said at least one path; means for adhesively affixing back strips to the spines of successive piles of coherent sheets in at least one third portion of said at least one path; and means for converting successive backstripped piles of coherent sheets into collections of sheets in at least one fourth portion of said at least one path.

17. The apparatus of claim 16, wherein said bonding means includes means for securing the marginal portions of sheets in each pile to each other with an adhesive.

18. The apparatus of claim 16, wherein said transporting means includes means for advancing the piles in a predetermined direction, said at least one second portion of said at least one path being disposed upstream of said at least one third portion, as seen in said direction.

19. The apparatus of claim 16, wherein said transporting means comprises means for advancing the piles in a predetermined direction, said at least one second portion of said at least one path being disposed downstream of said at least one third portion, as seen in said direction.

20. The apparatus of claim 16, each of the piles comprising elongated sheets having pairs of parallel long sides, wherein said transporting means comprises means for advancing successive piles of the series in the direction of the long sides of the respective sheets during transport along said at least one first portion of said at least one path.

21. The apparatus of claim 16, each of the piles comprising elongated sheets having pairs of parallel long sides, wherein said transporting means comprises means for advancing successive piles of the series at least substantially at right angles to the long sides of the respective sheets along said at least one second portion of said at least one path, said securing means including means for conveying a succession of first covers from a source to successive piles of the series in said at least one second portion of said at least one path, means for attaching successive first covers to one outermost sheet of each of said series of successive piles in said at least one second portion of said path, means for inverting successive piles and the respective first covers, means for conveying a succession of second covers from a source to successive inverted piles, and means for attaching successive second covers to the other outermost sheet of each of said series of successive inverted piles.

22. The apparatus of claim 21, wherein said securing means further includes a first adhesive applying coating device for first covers adjacent said first conveyor means and a second adhesive applying coating device for second covers adjacent said second conveyor means.

23. The apparatus of claim 16, further comprising means for compressing successive piles of said series of piles in a further portion of said at least one path downstream of said at least one second portion.

24. The apparatus of claim 16, wherein said converting means comprises means for trimming successive piles of said series and the respective covers downstream of said at least one second portion of said at least one path.

25. The apparatus of claim 16, wherein said converting means comprises means for trimming successive piles of said series, the respective covers and the respective back strips downstream of said at least one second and said at least one third portion of said at least one path.

26. The apparatus of claim 16, wherein said converting means includes means for assembling successive piles of said series, together with the respective covers and the respective back strips, into a series of successive blocks each having a single layer of neighboring piles, and means for subdividing the piles of successive blocks of said series of blocks into discrete collections of sheets.

27. The apparatus of claim 16, wherein said converting means includes means for assembling successive piles of said series, together with the respective covers and the respective back strips, into a series of successive blocks each having a plurality of superimposed piles, and means for subdividing the piles of successive blocks of said series of blocks into discrete collections of sheets.

* * * * *